US009575442B2

(12) United States Patent
Ohta et al.

(10) Patent No.: US 9,575,442 B2
(45) Date of Patent: Feb. 21, 2017

(54) IMAGE FIXING APPARATUS HAVING A HEATER, A THERMOSENSITIVE ELEMENT, AND A TENSION SPRING CONFIGURED TO BIAS OR URGE THE THERMOSENSITIVE ELEMENT

(71) Applicant: CANON KABUSHIKI KAISHA, Tokyo (JP)

(72) Inventors: Hideki Ohta, Numazu (JP); Jiro Moriya, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/088,505

(22) Filed: Apr. 1, 2016

(65) Prior Publication Data

US 2016/0216657 A1 Jul. 28, 2016

Related U.S. Application Data

(62) Division of application No. 14/541,707, filed on Nov. 14, 2104, now Pat. No. 9,335,686.

(30) Foreign Application Priority Data

Nov. 18, 2013 (JP) ..... 2013-237912
Oct. 6, 2014 (JP) ..... 2014-205611

(51) Int. Cl.
*G03G 15/20* (2006.01)

(52) U.S. Cl.
CPC ..... *G03G 15/2017* (2013.01); *G03G 15/2039* (2013.01); *G03G 15/2053* (2013.01)

(58) Field of Classification Search
CPC ..... G03G 15/2017
See application file for complete search history.

(56) References Cited

U.S. PATENT DOCUMENTS

| | | | | |
|---|---|---|---|---|
| 6,094,559 | A * | 7/2000 | Otsuka | G03G 15/2025 399/327 |
| 6,671,471 | B2 | 12/2003 | Nakamura et al. | |
| 8,755,734 | B2 | 6/2014 | Abe et al. | |
| 8,909,124 | B2 | 12/2014 | Kuwata et al. | |
| 9,335,686 | B2 * | 5/2016 | Ohta | G03G 15/2039 |
| 2002/0071700 | A1 | 6/2002 | Nishitani et al. | |
| 2007/0086804 | A1 * | 4/2007 | Seorl | G03G 15/2035 399/69 |
| 2013/0195532 | A1 | 8/2013 | Abe et al. | |
| 2013/0302060 | A1 | 11/2013 | Moriya et al. | |
| 2013/0336672 | A1 | 12/2013 | Mizuta et al. | |
| 2014/0233995 | A1 | 8/2014 | Kasuya et al. | |

FOREIGN PATENT DOCUMENTS

| | | |
|---|---|---|
| JP | 9-62138 A | 3/1997 |
| JP | 2007-58190 A | 3/2007 |
| JP | 2013-41096 A | 2/2013 |

* cited by examiner

*Primary Examiner* — G. M. Hyder
(74) *Attorney, Agent, or Firm* — Fitzpatrick, Cella, Harper & Scinto

(57) ABSTRACT

An image fixing apparatus includes: a heater for heating and fixing a toner image formed on a recording material; a thermosensitive element for sensing heat from the heater; and a tension spring for urging the thermosensitive element toward the heater.

12 Claims, 12 Drawing Sheets

IMAGE FIXING APPARATUS HAVING A HEATER, A THERMOSENSITIVE ELEMENT, AND A TENSION SPRING CONFIGURED TO BIAS OR URGE THE THERMOSENSITIVE ELEMENT

This is a division of U.S. patent application Ser. No. 14/541,707, filed on Nov. 14, 2014, now allowed.

FIELD OF THE INVENTION AND RELATED ART

The present invention relates to a fixing apparatus (device) which is mountable in an image forming apparatus, such as an electrophotographic printer and an electrophotographic copying machine.

One of the known fixing apparatuses (fixing devices) to be mounted in an electrophotographic printer, a copying machine, and the like, is a fixing device of the so-called film-heating type. This type of fixing device has: a heater consisting of a ceramic substrate, and a heat generating member disposed on the ceramic substrate; a cylindrical film which moves in contact with the heater; and a pressure roller which forms a nip between itself and the heater, with the presence of the film between itself and heater. A sheet of a recording medium, on which an unfixed toner image is present, is heated while it is conveyed through the nip, remaining pinched by the film and pressure roller, whereby the toner image on the sheet of the recording medium is thermally fixed to the sheet.

A fixing device of the so-called film-heating type is provided with a heater, a heater holder, a temperature detection element (thermistor or the like), and a protection element (thermal fuse or the like). The heater is supported by the heater holder, which is formed of a resinous substance. The temperature detection element and the protection element are disposed in contact with the opposite surface of the heater from the surface which forms the aforementioned nip. Regarding the structural arrangement for disposing the heat sensing element in contact with the heater, the fixing device is provided with a metallic stay for reinforcing the heater. The metallic stay is disposed on the opposite surface of the heater holder from the surface which supports the heater, and the heat sensing element is disposed between the heater holder and stay so that the heat sensing element can be placed in contact with the heater through a hole with which the heater holder is provided.

Conventionally, a heat sensing element is fixed so that its heat sensing portion contacts the heater. However, the contact pressure between the heat sensing element and the heater is relative low. Further, sometimes it occurs that the heat sensing element becomes separated from the heater. Thus, the level of accuracy of conventional fixing devices is sometimes inaccurate.

One of the proposals made to deal with this problem is disclosed in Japanese Laid-open Patent Application 2013-41096. In the case of this proposal, a protection element, which is an example of heat sensing element, is kept pressed toward (upon) the heater by pressure generating components, in order to improve the level of accuracy with which the protection element detects the abnormal temperature increase of the heater of the fixing device. More concretely, compression springs are used as the pressure generating components to keep the protection element pressed upon the heater. Therefore, the protection element is kept in contact with the heater in such a manner that the contact pressure between the protection element and the heater always remains at a preset amount, in order to ensure that the abnormal temperature increase of the heater is reliably detected.

In recent years, image forming apparatuses have been reduced in size. Therefore, fixing devices also have been reduced in size, which in turn has caused the external diameter of fixation films to be reduced. Consequently, the space between the heater holder and the stay has narrowed, making it difficult to dispose compression springs directly above the heat sensing element. Further, in the case of the protection element, in order to provide a sufficient amount of distance between the metallic stay and the protection element to electrically insulate the stay and the protection element from each other, it became necessary to hold the protection element with the use of a protection element holder formed of an electrically insulative resinous substance. This structural arrangement further reduced the space between the heater holder and the stay, making it difficult to dispose the above-described compression springs.

SUMMARY OF THE INVENTION

According to an aspect of the present invention, there is provided an image fixing apparatus comprising: a heater for heating and fixing a toner image formed on a recording material; a thermosensitive element for sensing heat from said heater; and a tension spring for urging said thermosensitive element toward said heater.

Further features of the present invention will become apparent from the following description of exemplary embodiments (with reference to the attached drawings).

DESCRIPTION OF THE PREFERRED EMBODIMENTS

Hereinafter, some of preferred embodiments of the present invention are described with reference to appended drawings. Although the following preferred embodiments of the present invention are the most preferable ones, they are not intended to limit the present invention in scope. That is, the present invention is applicable to various fixing devices different in structure from those in the following embodiments, within the scope of the present invention.

Figure 10:
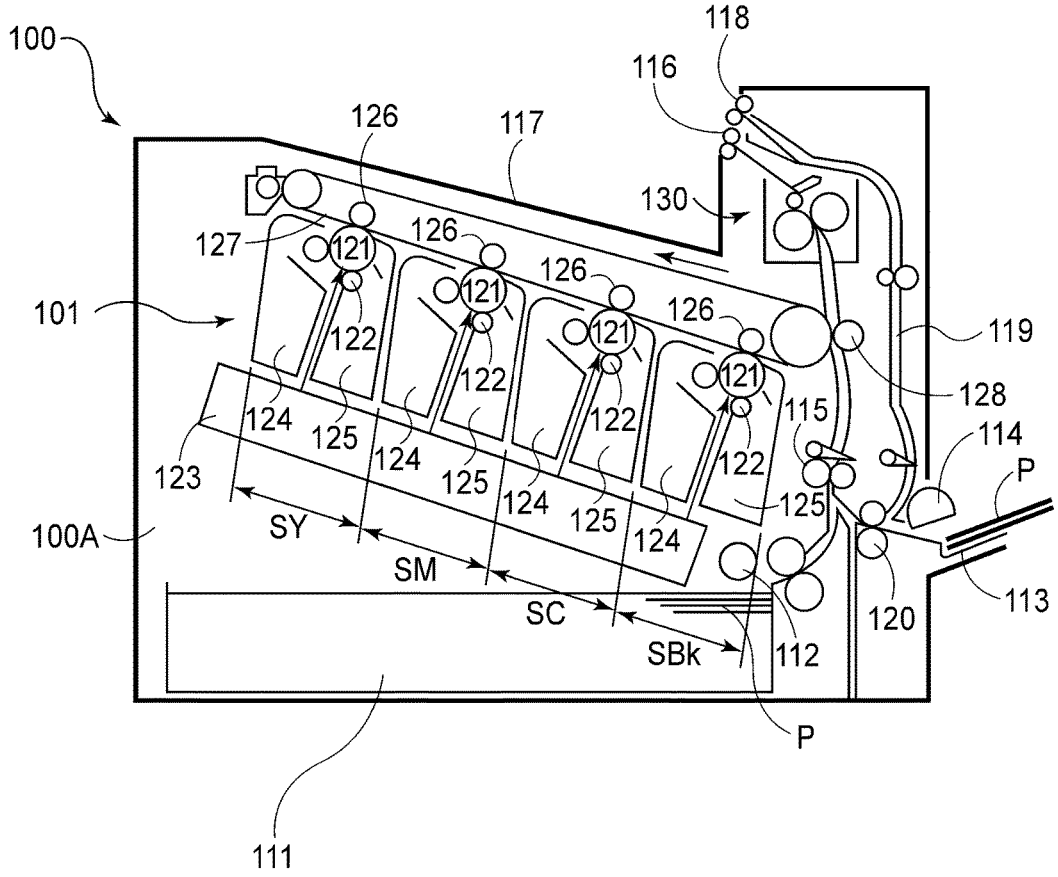
FIG. 10 is a sectional view of an image forming apparatus.

First, referring to FIG. 10, this drawing shows a typical image forming apparatus 100, in which a fixing device in accordance with the present invention is mountable. FIG. 10 is a sectional view of an image forming apparatus 100 (which in this embodiment is a full-color printer) based on electrophotographic recording technologies. It shows the general structure of the apparatus.

The image formation section 101 of the image forming apparatus 100, which is for forming a toner image on a sheet P of a recording medium, has four image formation stations SY, SM, SC and Bk, which form yellow, magenta, cyan and black toner images, respectively. Each image formation station has a photosensitive drum 121 as an image bearing member, a charging member 122, a laser scanner 123 (there are four scanners in scanner casing 123), a developing device 124, and a cleaner 125 for cleaning the photosensitive drum 121. Further, each image formation station has a transferring member 126. The printer 100 has also a belt 127 and a secondary transferring member 128, etc. The belt 127 bears and conveys a toner image after the transfer of the toner image onto the belt 127 by a transferring member. The secondary transferring member 128 transfers a toner image from the belt 127 onto the sheet P of a recording medium. The operation of the above-described image formation section has been well known. Here, therefore, it is not described in detail.

Sheets P of the recording medium stored in a cassette 111 in the main assembly 100A of the image forming apparatus 100 are moved one by one out of the cassette 111 by the rotation of a roller 112. In some cases, sheets P of the recording medium are placed on a tray 113, and are moved one by one out of the tray 113 by the rotation of a roller 114. Then, each sheet P of the recording medium is conveyed by the rotation of a roller 115 to the secondary transfer nip formed by the secondary transferring member 128 and the belt 127. After the transfer of an unfixed toner image onto the sheet P of the recording medium in the secondary transfer nip, the sheet P is sent to a fixing device (fixing section) 130, in which the unfixed toner image is thermally fixed to the sheet P. After the sheet P is moved out of the fixing device 130, it is discharged onto a tray 117 by the rotation of a roller 116.

In a case where the image forming apparatus 100 is in the two-sided printing mode, a sheet P of the recording medium is conveyed by the rotation of a roller 118 to a roller 120 by way of a two-sided mode sheet conveyance passage 119, and then, the sheet P is conveyed back to the secondary transfer nip by the rotation of the rollers 120 and 115 for the second time. Then, in the secondary transfer nip, another unfixed toner image is transferred onto the back surface (second surface) of the sheet P. Then, the sheet P is conveyed to the fixing device 130, in which the unfixed toner image on the back surface of the sheet P is thermally fixed to the sheet P. After being moved out of the fixing device 130, the sheet P is discharged into the tray 117 by the rotation of the roller 116.

Embodiment 1

(1) Fixing Device 130

Figure 1:
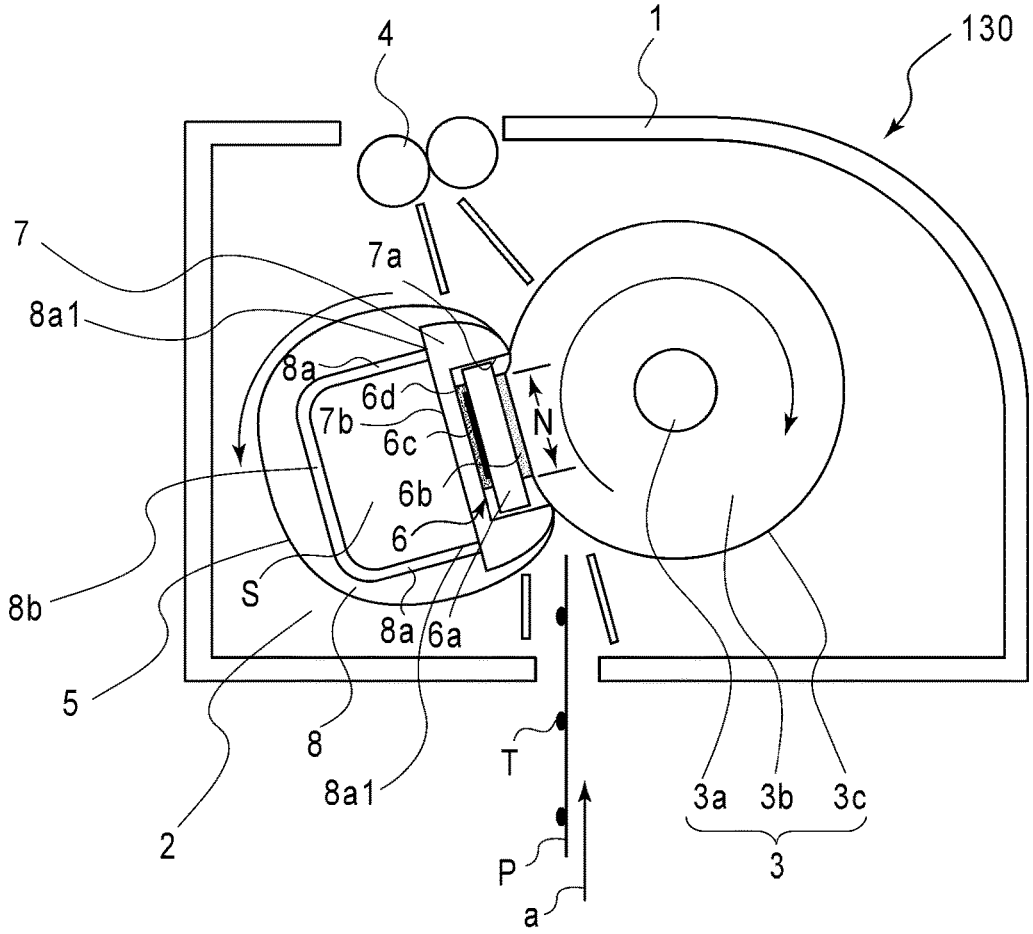
FIG. 1 is a sectional view of a fixing device.
Figure 2:
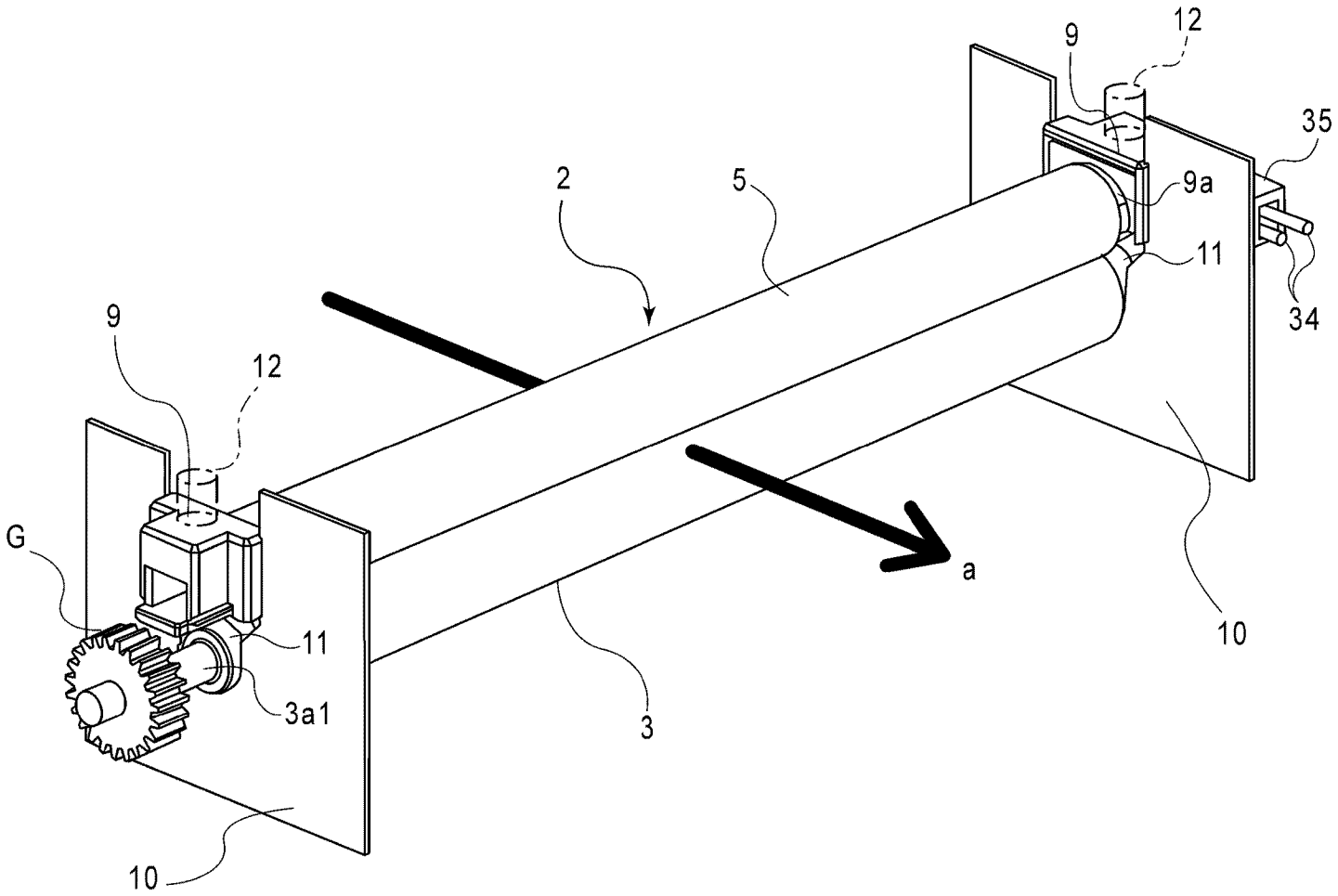
FIG. 2 is a perspective view of the fixing device.
Figure 3:
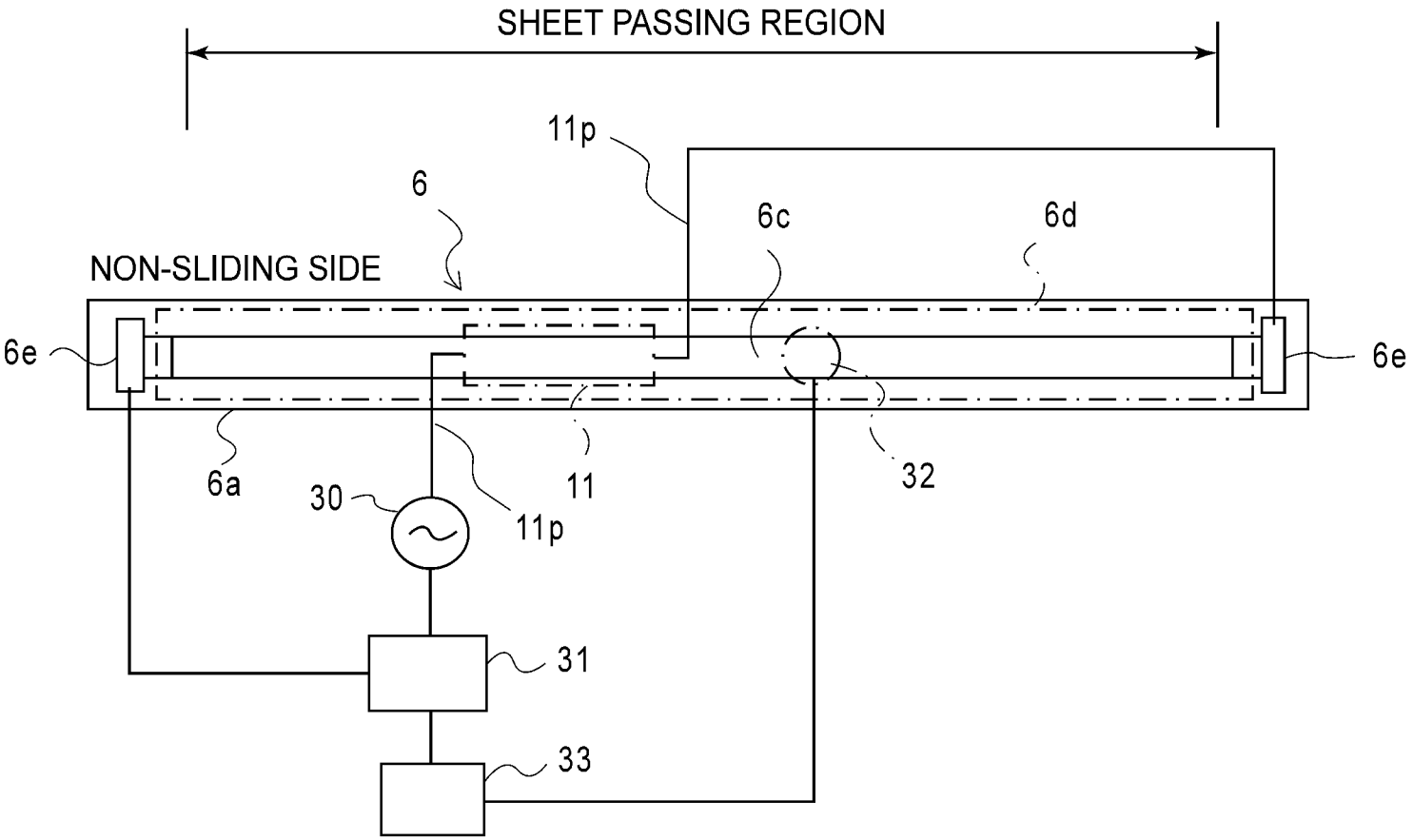
FIG. 3 is a drawing of a heater driving circuit.

FIG. 1 is a sectional view of the fixing device 130 in this embodiment. It shows the general structure of the fixing device 130. This fixing device 130 is of the so-called film-heating type. FIG. 2 is a perspective view of the fixing device 130, as seen from the downstream side of the device in terms of the recording medium conveyance direction. FIG. 3 is a drawing of the heater driving circuit of the fixing device 130.

Referring to FIGS. 1 and 2, the fixing device 130 has a heating unit 2, and a pressure roller 3 as a pressure applying component. The heating unit 2 has: a film 5, which is a cylindrical rotational component; a ceramic heater (which hereafter will be referred to simply as heater) 6 as a heat generating component; a holder (heater holder) 7, as a supporting component, which is formed of heat resistant resin; a stay 8 as a reinforcing component formed of a metallic substance; and a pair of flanges 9 (FIG. 2) as regulating components. The holder 7 has also a function of guiding the rotation of the film 5. Each of the pressure roller 3, the film 5, the heater 6, the holder 7, and the stay 8 is a long and narrow component, the lengthwise direction of which is perpendicular to the recording medium conveyance direction a.

Next, the structure of the heating unit 2 is described. The film 5 is flexible and heat resistant. The base layer of the film 5 may be formed of resin such as polyamide, or a metallic substance such as stainless steel. The film 5 may be laminar, being made up of a base layer and a rubber layer. It is desired that the film 5 is also provided with a parting layer, which is to be formed, as a surface layer, of fluorinated resin or the like.

The holder 7 is heat resistant and thermally insulative. Its surface, which faces the pressure roller 3, is provided with a groove 7*a* which extends in the lengthwise direction of the holder 7, being at the center in terms of the direction (widthwise direction) parallel to the recording medium conveyance direction a. The heater 6 is supported by the holder 7. That is, it is placed in this grove 7*a*, and is bonded to the holder 7.

The heater 6 has a ceramic substrate 6*a*. The surface of the ceramic substrate 6*a*, on which the inward surface of the film 5 slides, is provided with low-friction layer 6*b*, which comes into contact with the inward surface of the film 5. As the material for the low-friction layer 6*b*, heat resistant resin such as polyamide and polyamide, glass, or the like substance is used. The opposite surface of the heater substrate 6*a* from the surface, on which the film 5 slides, that is, the surface of the heater substrate 6*a*, on which the film 5 does not slide, is provided with a layer 6*a* of heat generating resistor, which generates heat as electric current flows through the layer 6*a*. The heat generating resistor layer 6*c* extends in the lengthwise direction of the heater substrate 6*a*. It is formed by printing. The surface of the heat generating layer 6*c* is covered with an electrically insulative layer 6*d*, which is formed of glass or the like substance. Reference characters 6*e* denote an electrode to which an electric power supply connector 35 (FIG. 2) is connected. In order to make it easier to understand the electric power supply circuit, FIG. 3 shows two electrodes 6*e*, which are located at the lengthwise ends of the heater 6, one for one. In reality, however, the two electrodes 6*e* are integrally positioned at one of the lengthwise ends of the heater 6. Thus, there is only one electric power supply connector 35, which corresponds to two electrodes 6*e*, as shown in FIG. 2. Reference numeral 34 denotes an electric power supply cable.

Referring to FIG. 3, the portion of the heater 6, which corresponds in position to the recording medium passage, is provided with a thermistor 32 as a temperature detecting component, and a thermo-switch (heat sensing element) 11 as a protection element. The thermistor 32 and the thermo-switch 11 are disposed so that they remain in contact the electrically insulative layer 6*d*.

The metallic stay 8 is long enough to extend beyond both of the lengthwise ends of the film 5. It is U-shaped in cross-section. More concretely, it has a pair of leg sections 8*a*, and a top plate section 8*b*, which connects the pair of leg sections 8*a*. The stay 8 is disposed so that the end portion 8*a*1 of each of the pair of leg sections 8*a* of the stay 8 contacts the opposite flat surface 7*b* of the holder 7 from the heater 6. Further, the stay 8 is disposed in a manner to cover the protection element 11. That is, the pair of leg sections 8*a* of the stay 8, top plate 8*b* of the stay 8, and flat surface 7*b* of the holder 7 make up a space S (FIG. 1) in which the protection element 11 is held. Thus, in order to reduce the diameter of the film 5 to reduce in size the heating unit 2, the distance from the flat surface 7*b* of the holder 7 to the top plate 8*b* of the stay 8 is set to the minimum value which is necessary for the space S to internally hold the protection element 11 (which is described later).

The film 5 is loosely fitted around the holder 7 which supports the heater 6, and to which the stay 8 is fixed, as described above. The film 5 is guided by a guide 9*a*, which is a part of the flange 9, by the inward surface of each of its lengthwise end portions.

The pressure roller 3 has a metallic core 3*a* formed of aluminum, iron, stainless steel, or the like, and an elastic layer 3*b* formed of heat resistant elastic substance such as silicone rubber. It has also a parting layer 3*c* formed of fluorinated resin or the like, on the outward surface of the elastic layer 3*b*.

Referring to FIG. 2, the fixing device 130 in this embodiment is structured so that the shaft portions 3*a*1 of the metallic core 3*a* of its pressure roller 3 are rotatably supported by the left and right lateral plates 10, with the placement of a pair of bearings 11 between the shaft portions 3*a* and lateral plates 10, one for one. The left and right lateral plates 10 are parts of the frame 1 (FIG. 1) of the fixing device 130. Further, the pair of flanges 9 of the heating unit 2 are supported by the left and right lateral plates 10, in such a manner that the heater 6 of the heating unit 2 opposes the pressure roller 3, with the presence of the film 5 between the heater 6 and pressure roller 3 (FIG. 1). Further, each flange 9 is kept pressed by one of the pressure application springs 12, in the direction perpendicular to the generatrix of the film 5, whereby the stay 8 also is kept pressed by the pressure application springs 12, through the flange 9. Thus, the elastic layer 3*b* of the pressure roller 3 is elastically deformed, creating a nip N, which has a preset width, between the surface of the film 5 and the surface of the pressure roller 3. In other words, the fixing device 130 has the cylindrical film 5 which rotates, with its inward surface remaining in contact with the heater 6, and the pressure roller 3 which forms the nip N between itself and heater 6, with the presence of the film 5 between itself and heater 12*c*, in coordination with the heater 6. By the way, the stay 8, which is shaped like a letter U in cross section, plays also a role of applying pressure to the fixation nip N, through which the recording medium is conveyed while remaining pinched by the pressure roller 3 and film 5.

(2) Thermal Fixing Operation of Fixing Device 130

Next, referring to FIGS. 1-3, the thermal fixing operation of the fixing device 130 is described. As the driving force of a motor (unshown), with which the main assembly 100A of the image forming apparatus 100 is provided, is transmitted to the pressure roller 3 through a gear G (FIG. 2), the pressure roller 3 is rotated in the direction indicated by an arrow mark (FIG. 1). Thus, the film 5 is rotated in the direction indicated by another arrow mark (FIG. 1) by the rotation of the pressure roller 3 while remaining in contact with the low-friction layer 6*b* of the heater 6 by its inward surface.

As the heat generating resistor layer 6*c* of the heater 6 is supplied with electric power from a commercial AC power source 30, the heater 6 quickly increases in temperature. A control section 33 made up of a CPU and memories such as a RAM and a ROM turns on or off, in order to control the electric power supply to the heat generating resistor layer 6*c* to regulate the temperature detected by the thermistor 32, which monitors the temperature of the heater 6 remains at the fixation level (target level).

A sheet P of the recording medium, on which an unfixed toner image T is present, is heated while it is conveyed through the nip N, remaining pinched by the pressure roller 3 and film 5. Consequently, the toner image T is fixed to the surface of the sheet P.

(3) Structural Arrangement for Keeping Protection Element 11 Under Pressure

The protection element 11 is disposed in the space S which is on the inward side of the stay 8 of the heating unit 2. It is kept pressured toward the heater 6 by pair of tension springs 13, as a pressure applying means. That is, the protection element 11 (heat sensing element) 11 and the tension springs 13 are disposed in the hollow of the stay 8.

Figure 4:
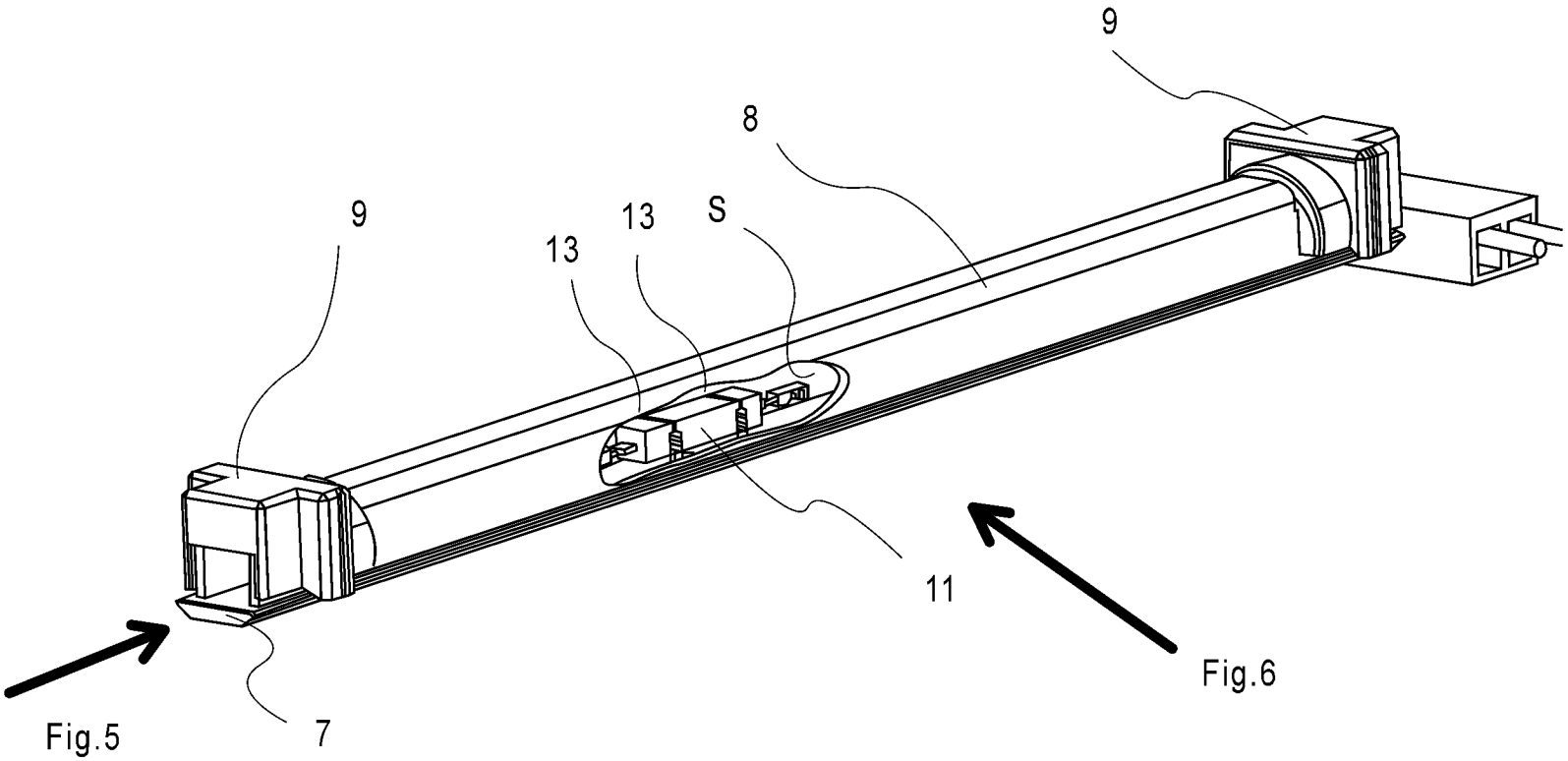
FIG. 4 is a perspective view of a combination of the protection element disposed on the inward side of the stay of the fixing device, and tension springs, in the first embodiment of the present invention.
Figure 5:
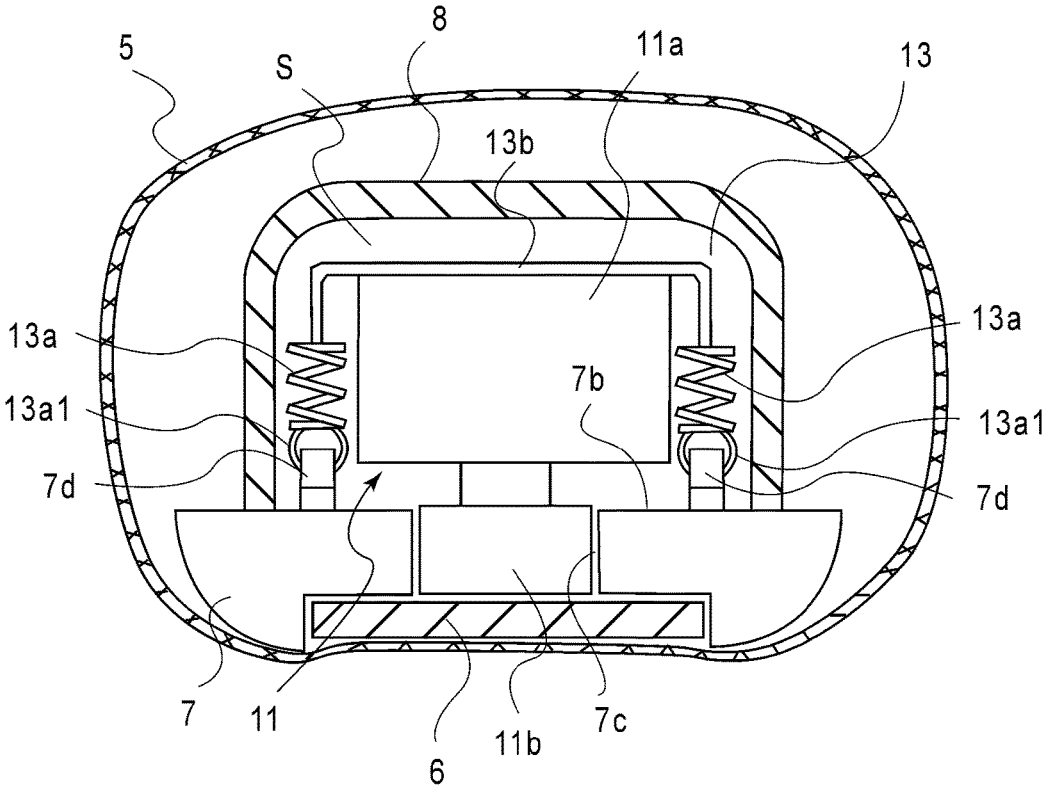
FIG. 5 is a sectional view of the heating unit in the first embodiment.
Figure 6:
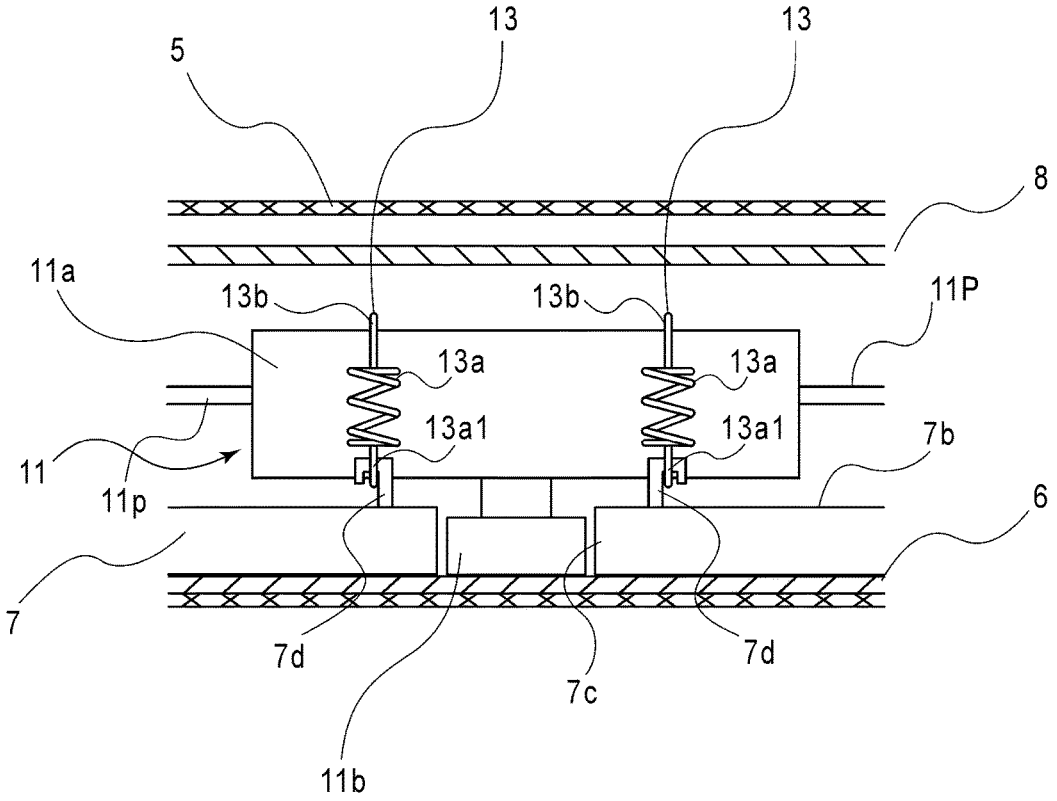
FIG. 6 is a sectional view of the heating unit in the first embodiment, at a plane parallel to the front surface of the fixing device.

FIG. 4 is a perspective view of the heating unit 2 after the removal of the film 5. It shows the protection element 11 and the tension springs 13, which are disposed in the hollow of the stay 8. FIGS. 5 and 6 are sectional and front views, respectively, of the portion of the heating unit 2 that has the protection element 11. In FIGS. 5 and 6, the heater 6 is simply drawn on purpose, in order to prevent the drawings from appearing unnecessarily complicated.

The protection element 11 senses the heat attributable to the abnormal increase of the temperature of the heater 6, and is activated by the heat to forcefully block the electric power supply to the heater 6. Referring to FIG. 4, it is disposed in the inward space S (hollow) of the stay 8. Referring to FIGS. 5 and 6, it has a main section 11*a* and a pair of heat sensing sections 11*b*. The main section 11*a* is formed of an electrically insulative substance, and is roughly in the form of a parallelepiped. It is disposed so that its lengthwise direction becomes parallel to the lengthwise direction of the holder 7. The pair of heat sensing section 11*b* are formed and disposed so that they extend toward the heater 6, from the corresponding ends of the main section 11*a*. That is, the pair of heat sensitive (thermosensitive) sections 11*b* are terminals which extend from the lengthwise ends of the protection element 11, one for one. Each heat sensing section 11*b* is in contact with the surface of the electrically insulative layer 6*d* of the heater 6, through the corresponding hole 7*c* with which the holder 7 is provided. It is formed of aluminum.

The main section 11*a* contains: a piece of bimetal, which bends in the thickness direction of the holder 7 as its temperature becomes higher than a preset level; a supporting post which is moved by the bending of the bimetal; and electrical contacts (unshown) formed of plate springs. As for the operation of the protection element 11 provided with the main section 11*a* structured as described above, as the temperature of the heater 6, which is sensed by the heat sensing section 11*b*, exceeds the preset level, the bimetal bends in the above-described direction, causing thereby the supporting post to move. Thus, the electrical contact formed of plate spring is made to float (disengage), by the supporting post. Consequently, the electric power supply to the heater 6 is blocked.

Each of the pair of tension spring 13 has a pair of coil (spiral) sections 13*a*, and a connective section 13*b* which connects the pair of coil (spiral) sections 13*a*. Each connective section 13*b* is in contact with the opposite surface of the main section 11*a* of the protection element 11 from the heater 6. Further, the tension spring 13 is bent in the shape of a letter U so that the coil (spiral) sections 13*a* contact the upstream and downstream sides, respectively, of the holder 7, in terms of the recording medium conveyance direction. There are provided two tension springs 13, which are disposed so that they are symmetrically positioned with reference to the heat sensitive section 11*b* in terms of the lengthwise direction of the main section 11*a* (FIG. 6).

Referring to FIGS. 5 and 6, each of the tension springs 13, which is positioned, as described above, relative to the main section 11*a*, has the first bent portion 13*a*1, which is bent in a manner to form a ring. This first bent portion 13*a*1 is held by the second bent portion 7*d* of the holder 7, which is in the form of a key. Therefore, the protection element 11 remains pressed toward the heater 6 by the tension of each tension spring 13. That is, the tension springs 13 are positioned so that they surround the protection element 11. More concretely, the lengthwise ends of each tension spring 13 are fixed to the heater holder 7 so that the tension spring 13 surrounds the protection element 11. Thus, the protection element 11 remains pressured toward the heater 6.

The tension springs 13 are structured so that the amount of tension they produce are the same. Therefore, they can keep the protection element 11 pressed upon the heater 6, while preventing the protection element 11 from tilting.

This embodiment of the present invention can enable the fixing device 130 to keep its protection element 11 pressed upon the heater 6, even if there is no space for the compression springs, on the opposite side of the heater 6 from the side on which the protection element 11 is placed in contact with the heater 6. Therefore, it can make the level of accuracy of the fixing device 130 with which the protection element 11 can detect the heat attributable to the excessive temperature increase of the heater 6 satisfactory.

Embodiment 2

Next, another example of fixing device 130 which is in accordance with the present invention is described. The fixing device 130 in this embodiment is the same in structure as the fixing device 130 in the first embodiment, except for the structural arrangement for keeping the protection element 11 pressed. The components, portions thereof, etc., of the fixing device 130 in this embodiment, which are the same as the counterparts of the fixing device 130 in the first embodiment are given the same reference characters as those given to the counterparts, and are not described in order not to repeat the same descriptions.

The structural arrangement, in this embodiment, for keeping the protection element 11 under pressure is such that a holding member 20 as a holding component, and a tension spring 21 as a pressure applying means, are disposed in the hollow of the stay 8 of the heating unit 2, to keep the protection element 11 pressed toward the heater 6.

Figure 7:
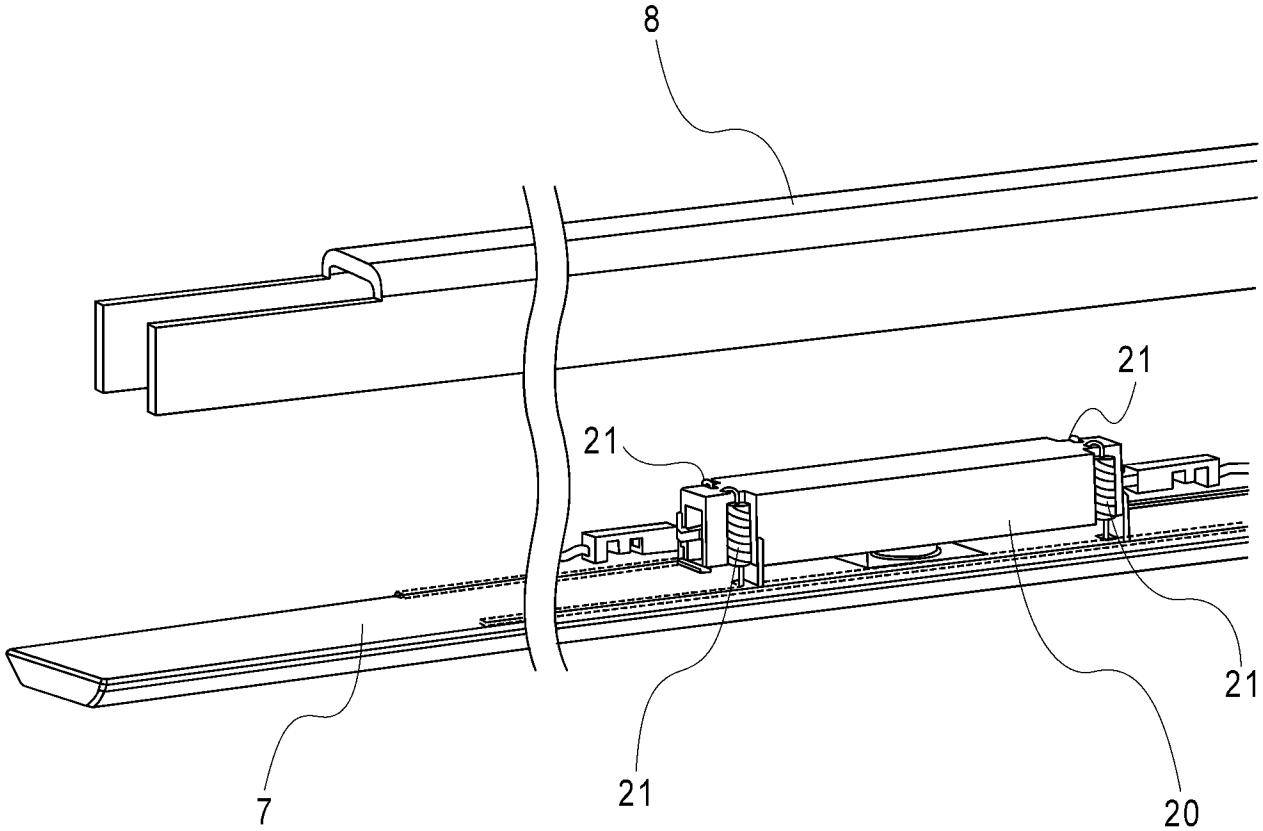
FIG. 7 is a perspective view of the protection element, holding member, and tension springs, which are disposed on the inward side of the stay of the fixing device, in the second embodiment of the present invention.
Figure 8:
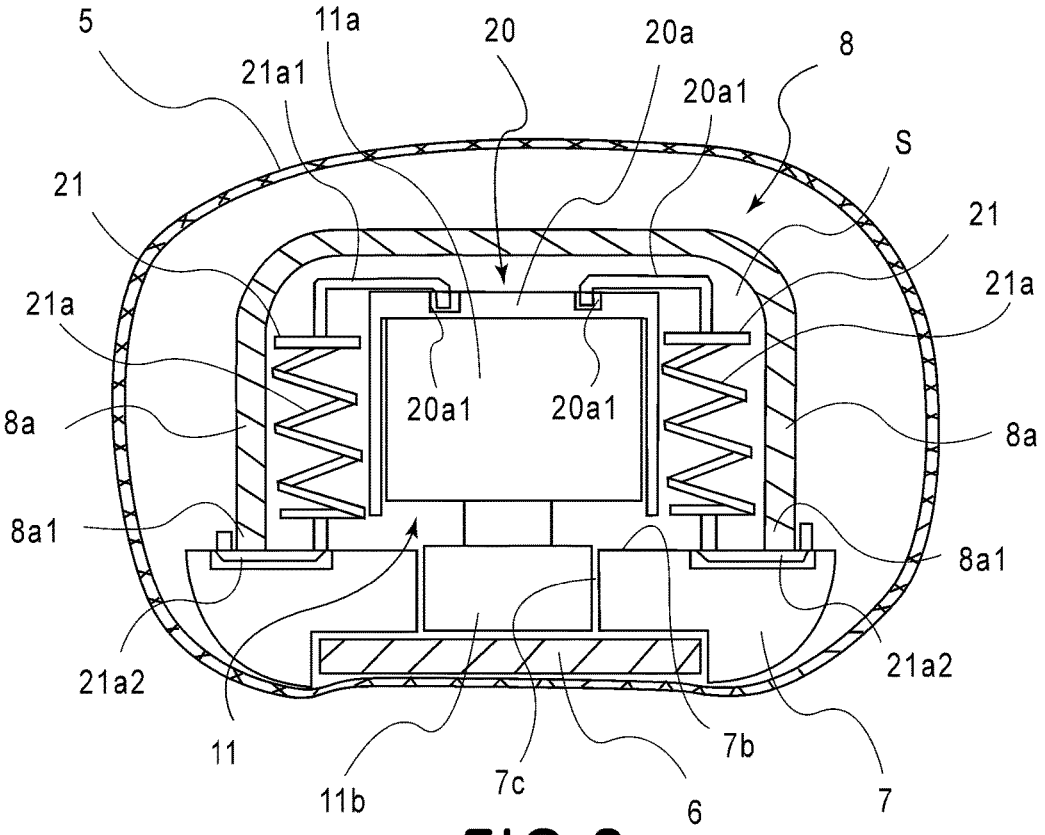
FIG. 8 is a sectional view of the heating unit in the second embodiment.
Figure 9:
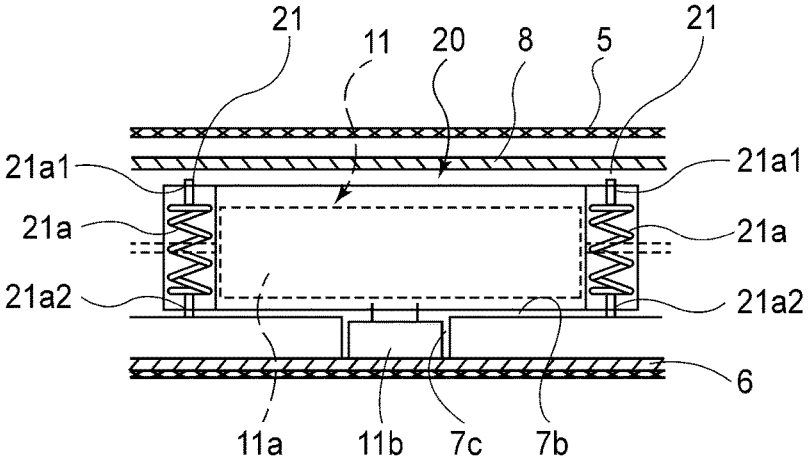
FIG. 9 is a sectional view of the heating unit in the second embodiment, at a plane parallel to the front surface of the fixing device.

FIG. 7 is a perspective view of the heating unit 2 after the removal of the film 5. It shows the protection element 11, the holding member 20, and tension springs 21, which are disposed in the hollow of the stay 8. FIGS. 8 and 9 are sectional and front views, respectively, of the portion of the heating unit 2, which has the protection element 11. In FIGS. 8 and 9, the heater 6 is plainly drawn on purpose, in order to prevent the drawings from appearing unnecessarily complicated.

Referring to FIGS. 7 and 8, the holding member 20 is formed of a resinous substance. It is shaped so that its cross-section looks like a letter U. This holding member 20 is slightly greater in length than the main section 11*a* of the protection element 11 (FIG. 9). It holds the main section 11*a* from the opposite side of the main section 11*a* from the heater 6. That is, the protection element 11 is held by the holding member 20. The fixing device 130 is provided with four tension springs 21. Each tension spring 21 is provided with a single coil (spiral) portion 21*a*. In terms of the lengthwise direction of the main section 11*a*, four tension springs 21 are disposed in pairs so that the two pairs of tension springs 21 are symmetrically positioned with reference to the heat sensing portion 11*b* (FIGS. 7 and 9).

Each tension spring 21 has the first bent portion 21*a*1 which is shaped like a letter L, and the second bent portion 21*a*2 which also is shaped like a letter L. Referring to FIGS. 8 and 9, the first bent portion 21*a*1 is held in the hole 20*a*1 with which the top plate portion 20*a* of the holding member 20 is provided. The second bent portion 21*a*2 is held between the end portion of the leg section 8*a* of the stay 8, and the heater holder 7. Thus, each tension spring 21 keeps the protection element 11 pressed toward the heater 6, with the placement of the holding member 20 between the first bent portions 21*a*1 and main section 11*a*. That is, each tension spring 21 is held by the holding member 20 and the stay 8, which are independent from the protection element 11, so that the tensional force of each tension spring 21 acts on the protection element 11 to keep the protection element 11 pressed upon the heater 6. As described above, in this embodiment, one end of the tension spring 21 is practically fixed to the stay 8, whereby the protection element 11 remains pressed toward the heater 6.

The four tension springs 21 are made the same in tensional force. Therefore, it is possible to keep the protection element 11 pressed upon the heater 6 in such a manner that the protection element 11 does not tilt.

This embodiment of the present invention can enable the fixing device 130 to keep its protection element 11 pressed upon the heater 6, even if there is no space for the compression springs, on the opposite side of the heater 6 from the side on which the protection element 11 is placed in contact with the heater 6. Therefore, it can make the fixing device 130 satisfactory in terms of the level of accuracy, with which the protection element 11 can detect the heat attributable to the excessive temperature increase of the heater 6.

Embodiment 3

Figure 11:
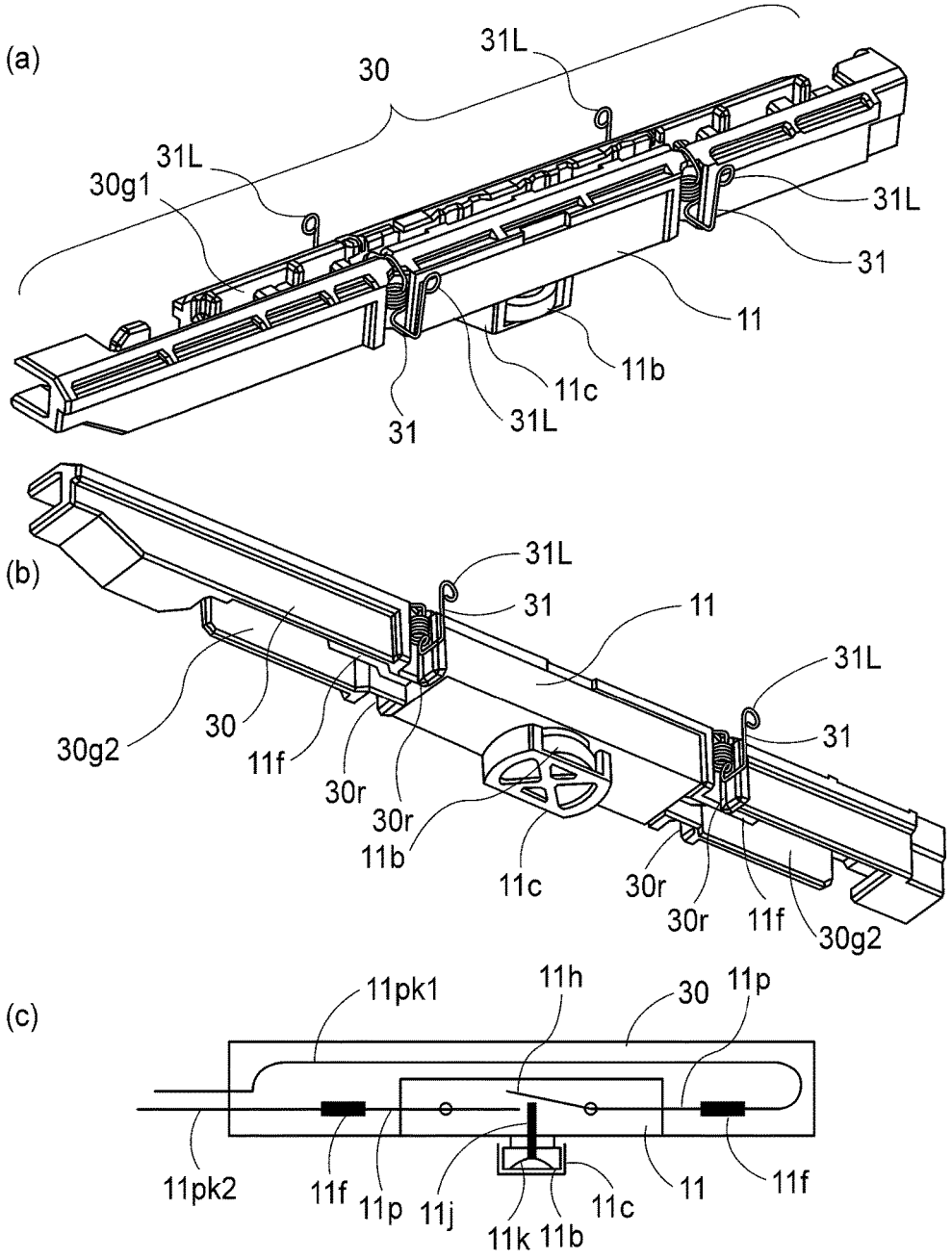
FIG. 11 is perspective views ((a) and (b)) and a sectional view ((c)), respectively, of the element holder in the third embodiment of the present invention, when the element holder is holding the protection element.
Figure 12:
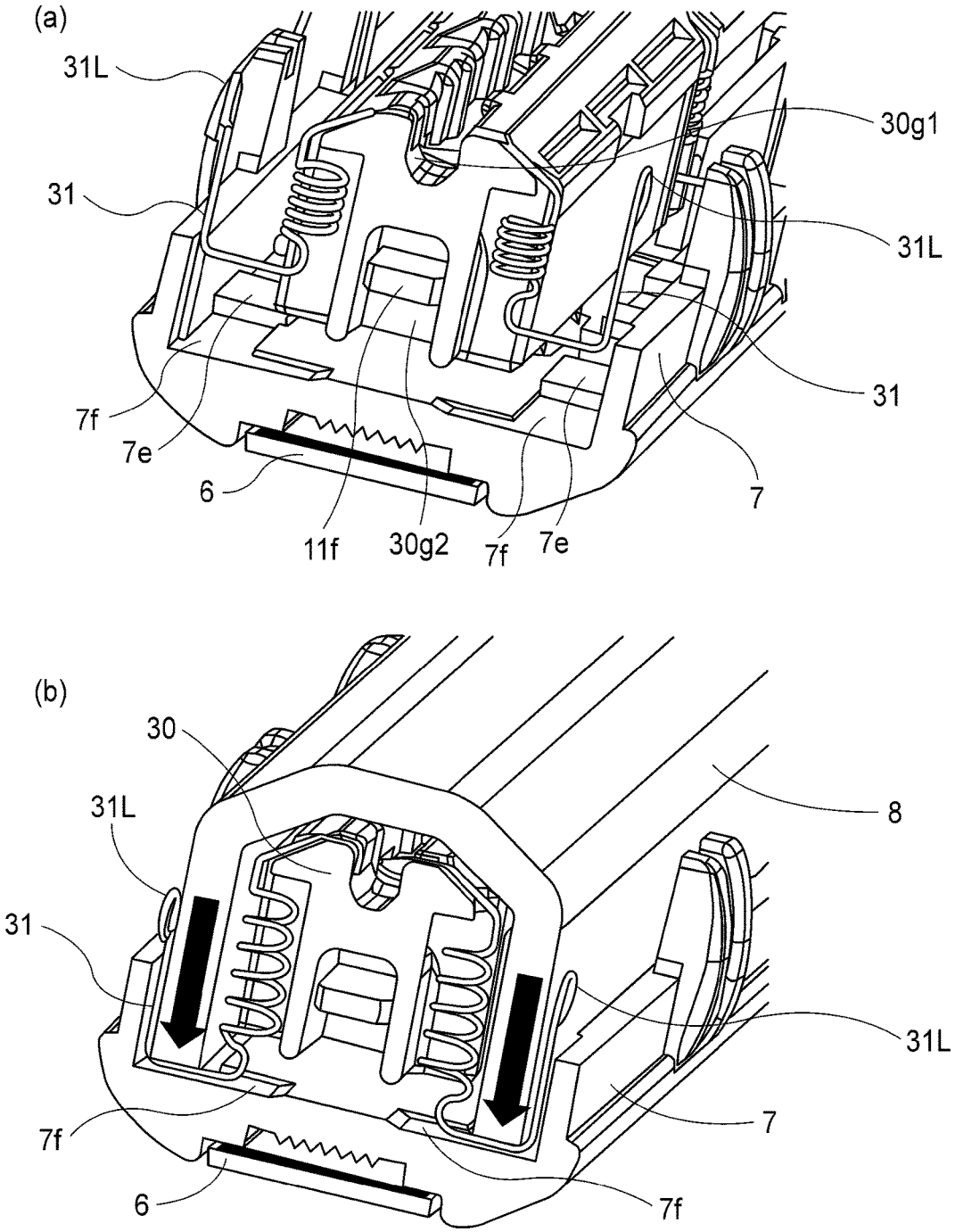
FIG. 12 is a sectional view of the heating unit in the third embodiment.
Figure 13:
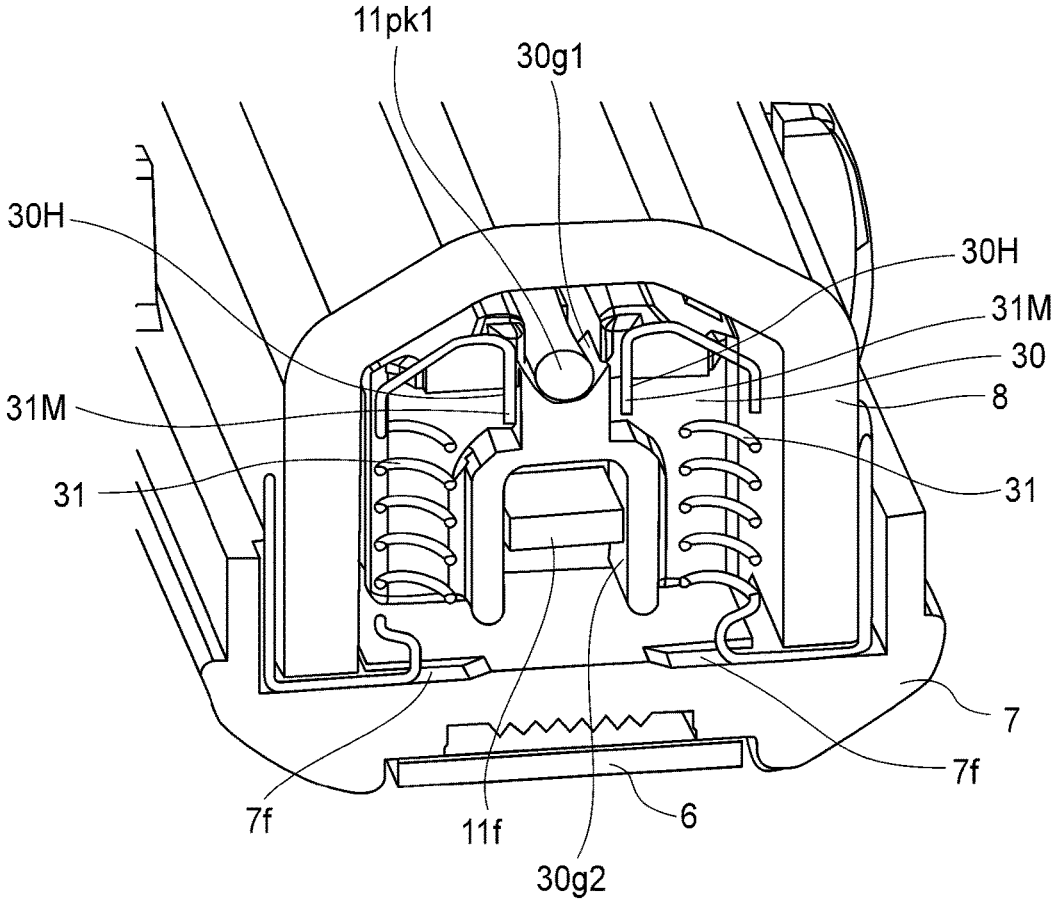
FIG. 13 is a sectional view of the heating unit in the third embodiment.

Next, referring to FIGS. 11-13, the third embodiment of the present invention is described. FIGS. 11(*a*) and 11(*b*) are perspective views of an element holder 30 when the element holder 30 is holding the protection element 11. FIG. 11(*c*) is a schematic sectional view of the element holder 30 when the holder 30 is holding the protection element 11. Like the fixing device 130 in the first embodiment, the fixing device 130 in this embodiment is also structured so that the protection element 11 is kept pressed toward the heater 6 by the four tension springs. By the way, reference characters 11*c* denote a cap made of resin. The cap 11*c* is for covering the heat sensing section 11*b*, which is made of a metallic substance. The resinous cap 11*c* is a component for providing a gap between the heater 6 and the heat sensing section 11*b* of the protection element 11. With the provision of this gap, it is possible to prevent the problem that the protection element 11 reacts when the heater 6 is normal in temperature. As the heater 6 abnormally increases in temperature, the cap 11*c* melts. Since the protection element 11 remains pressed toward the heater 6 by the tension springs 31, the heat sensing section 11*b* comes into contact with the heater 6, and therefore, the protection element 11 reacts. Reference characters 11*k* denote a piece of bimetal, which is shaped like a dome and is in the heat sensing section 11*a*. Reference characters 11*j* and 11*h* denote a rod which is pushed up by the bimetal 11*k*, and a switch portion, respectively. A pair of terminals 11*p*, which are the lengthwise end portions of the switch portion 11*h*, are in contact with cables 11*pk*1 and 11*pk*2, one for one; they are attached to the cables 11*pk*1 and 11*pk*2 with the use of a pair of crimps 11*f*. Referring to FIG. 11(*c*), the cable 11*pk*1 is bent in the element holder 30. The two cables 11*pk*1 and 11*pk*2 are extended outward from one of the lengthwise ends of the element holder 30.

More concretely, the cable 11*pk*1 is extended along the inward side of the guiding portion 31*g*2, with which the element holder 30 is provided, whereas the cable 11*pk*2 is extended along the inward side of the guiding portion 31*g*2, with which the element holder 30 is provided.

Next, referring to FIG. 11(*b*), the element holder 30 is provided with grooves 30*r* for accommodating the spiral portion of the tension spring 31. One 31M of the end portions of the tension spring 31 is inserted in the hole 30H (FIG. 13), whereas the other end portion 31L of the tension spring 31 is bent in a manner to form a ring, making it easier for an assembly line worker to handle the tension spring 31 when the worker assembles the device.

FIG. 12(*a*) shows the state of the tension spring portions of the heating unit 2, in which the portions are before the attachment of the metallic stay 8. FIG. 12(*b*) shows the state of the tension spring portions of the heating unit 2, in which the portions are after the attachment of the metallic stay 8. The heater holder 7 is provided with a stay-bearing surface 7*e*, with which the leg sections of the stay 8 come into contact, and a recess 7*f* which is recessed relative to the stay-bearing surface 7*e*. As the stay 8 is pushed into the partially assembled heating unit 2 in the direction indicated in FIG. 12(*b*) when the heating unit 2 is in the state shown in FIG. 12(*a*), the leg sections of the stay 8 come into contact with the stay-bearing surface 7*e*. Thus, the tension spring 31 is pushed downward by the leg sections of the stay 8. However, it retreats into the recess 7*f*. Thus, the leg sections of the stay 8 are allowed to come into contact with the stay-bearing surface 7*e*, being thereby stabilized in position. As the tension spring 31 is stretched as shown in FIG. 12(*b*), the element holder 30 is pressed toward the heater 6 by the force of the tension spring 31 while holding the protection element 11. In the case of this embodiment, therefore, the tension spring 31 is fixed to the element holder 30 and stay 8. That is, the protection element 11 remains pressed toward the heater 6, because one end of the tension spring 31 is fixed to the element holder 30, and the other end of the tension spring 31 is fixed to the stay 8.

As described above, the element holder 30 is provided with the grooves 30*r* which accommodate the spiral portion of the tension spring 31. Therefore, it is easier to find where the tension spring 31 is to be attached. Thus, the heating unit 2 in this embodiment is easier to assemble than those in the preceding embodiments. Further, the heater holder 7 is provided with the recesses 7*f*, into which the tension springs 31 are allowed to retreat, one for one. Therefore, the stay 8 of the heating unit 2 in this embodiment is more stable in position than those in the preceding embodiments.

[Miscellanies]

Regarding the fixing device 130 in the first embodiment, the choice of the component by which one end of the tension spring 13 is held does not need to be limited to the holder 7. For example, it may be the stay 8.

Also regarding the fixing device 130 in the first embodiment, the heating unit 2 may be structured so that the main section 11*b* of the protection element 11 is held by a holding member (unshown), and the protection element 11 is pressed toward the heater 6 by the connective portion 13*b* of the tension spring 13, which is between the two spiral portions of the tension spring 13, with the placement of the holding member between the connective portion 13*b* and main section 11*b*.

Next, regarding the fixing device 130 in the second embodiment, the choice of the component for holding the lengthwise ends of the tension spring 21 does not have to be limited to the combination of the holding member 20 and stay 8. That is, it may be a combination of the main section 11*b* of the protection element 11 and holder 7, a combination of the holding member 20 and stay 8, or a combination of the main section 11*b* of the protection element 11 and stay 8.

Regarding the fixing device 130 in the first or second embodiment, a heater structured so that the heat generating resistor layer 6*c* and the electrically insulative layer 6*d* are placed in layers on the film-facing surface of the substrate 6*a*, may be used in place of the heater 6. In such a case, the heat sensing section 11*b* of the protection element 11 is placed directly in contact with the opposite surface of the substrate 6*a* from the surface on which the film 5 slides.

Regarding the fixing devices 130 in the first to third embodiments, the choice of the heat sensing element which is pressed upon the heater 6 by the tension springs 13 or 21 does not need to be limited to the protection element 11. It may be a temperature detection element such as a thermistor. That is, the heat sensing element may be replaced with one of a thermistor, a thermal fuse, and a thermo-switch.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Applications Nos. 237912/2013 and 205611/2014 filed Nov. 18, 2013 and Oct. 6, 2014, respectively, which are hereby incorporated by reference.

What is claimed is:

1. An image fixing apparatus:

a heater configured to heat and fix a toner image formed on a recording material;

a heater holder configured to hold said heater, a thermosensitive element configured to sense heat from said heater; and a tension spring configured to urge said thermosensitive element toward said heater, wherein at least one end of said tension spring is fixed to said heater holder, by which said thermosensitive element is urged toward said heater, and wherein said tension spring is provided so as to surround said thermosensitive element.

2. An apparatus according to claim 1, wherein said tension spring has opposite ends fixed to said heater holder so as to surround said thermosensitive element, by which said thermosensitive element is urged toward said heater.

3. An apparatus according to claim 2, wherein said tension spring has two helical portions.

4. An apparatus according to claim 1, further comprising an element holder configured to hold said thermosensitive element, wherein said tension spring urges said thermosensitive element through said element holder.

5. An apparatus according to claim 1, further comprising a plurality of tension springs provided at symmetrical positions with respect to a thermosensitive portion of said thermosensitive element in a longitudinal direction of said heater.

6. An apparatus according to claim 1, wherein said thermosensitive element is one of a thermistor, a temperature fuse and a thermo-switch.

7. An apparatus according to claim 1, further comprising a cylindrical rotatable film having an inner surface in contact with said heater, and a roller constituting a nip with said heater through said film.

8. An apparatus according to claim 1, wherein said tension spring is provided at a position different from a position of said thermosensitive element in a longitudinal direction of said heater.

9. An image fixing apparatus:

a heater configured to heat and fix a toner image formed on a recording material;

a heater holder configured to hold said heater, a thermosensitive element configured to sense heat from said heater; and a plurality of tension springs configured to urge said thermosensitive element toward said heater, wherein the plurality of tension springs are provided at symmetrical positions with respect to a thermosensitive portion of said thermosensitive element in a longitudinal direction of said heater.

10. An apparatus according to claim 9, wherein at least one end of each of said tension springs is fixed to said heater holder, by which said thermosensitive element is urged toward said heater.

11. An apparatus according to claim 9, wherein said thermosensitive element is one of a thermistor, a temperature fuse and a thermo-switch.

12. An apparatus according to claim 9, further comprising a cylindrical rotatable film having an inner surface in contact with said heater, and a roller constituting a nip with said heater through said film.

* * * * *